US005248978A

United States Patent [19]

Manthy et al.

[11] Patent Number: 5,248,978

[45] Date of Patent: Sep. 28, 1993

[54] UNDERWATER GUIDE VEHICLE FOR REMOVAL OF SUBMERGED AND FLOATING NAVIGATIONAL HAZARDS

[75] Inventors: Robert S. Manthy, East Windsor, Conn.; R. Norris Keeler, McLean, Va.; Kirk Daniels, West Suffield, Conn.; Patrick L. Renehan, Laurel, Md.; Anthony R. Wells, The Plains, Va.

[73] Assignee: Kaman Aerospace Corporation, Bloomfield, Conn.

[21] Appl. No.: 760,872

[22] Filed: Sep. 16, 1991

Related U.S. Application Data

[63] Continuation-in-part of Ser. No. 746,645, Aug. 16, 1991.

[51] Int. Cl.[5] ..... G01S 13/86; G01S 15/89; G01S 13/89

[52] U.S. Cl. ..... 342/54; 358/103; 367/88; 114/21.2; 114/21.3; 89/1.54; 342/25; 342/62; 342/13; 342/68

[58] Field of Search ..... 342/25, 64, 13, 62, 342/68, 54; 358/103, 99, 108, 109; 367/88, 95, 96, 197, 119, 131, 134, 145, 146, 147; 89/1.54; 114/21.2, 21.3; 356/1, 2, 4, 51

[56] References Cited

U.S. PATENT DOCUMENTS

| | | | |
|---|---|---|---|
| 4,030,096 | 6/1977 | Stevens et al. | 342/90 |
| 4,088,978 | 5/1978 | Gilmour | 367/88 |
| 4,802,148 | 1/1989 | Gilmour | 367/88 |
| 4,912,685 | 3/1990 | Gilmour | 367/88 |
| 5,022,015 | 6/1991 | Gilmour | 367/124 |
| 5,042,942 | 8/1991 | Brimberg et al. | 356/1 |
| 5,043,951 | 8/1991 | Gilmour et al. | 367/126 |

*Primary Examiner*—John B. Sotomayor
*Attorney, Agent, or Firm*—Fishman, Dionne & Cantor

[57] ABSTRACT

An underwater maneuverable vehicle is presented which carries an explosive charge and can be used for immediate removal or destruction of various menaces to navigation and other underwater hazards. The battery powered vehicle is air dropped from a platform which carries an imaging lidar system for detection and is operated and navigationally controlled in conjunction with an imaging lidar system.

24 Claims, 10 Drawing Sheets

UNDERWATER GUIDE VEHICLE FOR REMOVAL OF SUBMERGED AND FLOATING NAVIGATIONAL HAZARDS

CROSS-REFERENCE TO RELATED APPLICATION

This is a continuation-in-part of application Ser. No. 746,645 filed Aug. 16, 1991.

BACKGROUND OF THE INVENTION

This invention relates generally to a sensor system for remote detection and imaging of objects submerged underwater and an underwater vehicle guided by the sensor system for removing submerged navigational hazards. More particularly, this invention relates to a method and apparatus for detecting, locating, imaging and removing (e.g., destroying) underwater objects such as mines by use of an underwater self-propelled vehicle which is guided from an airborne platform using a novel imaging lidar (light detection and ranging) system.

It is desirable in a number of military and civilian applications to search a volume within a backscattering medium for the presence of certain targets. For instance, moored or bottom mines deployed in ocean shipping lanes are a hazard to navigating ships used both for military and for commercial purposes. For other civilian applications such as law enforcement on the ocean, it is desirable to detect the presence of submerged fishing nets or drug-carrying containers used in smuggling contraband. In or near harbors and beaches, it is also desirable to detect submerged obstructions, anchors, cables, abandoned pipelines, barrels, oil drums, etc. In strictly military applications, anti-submarine warfare demands an effective means of detecting and locating submarines.

Presently, cumbersome and time consuming wire line devices must be used for detecting underwater targets from remote airborne locations. These devices are lowered into the water and of course, are easily subject to damage and loss. Also, wire line devices make target searching relatively slow and can only detect targets without providing visual imaging.

An improved and novel system for remote detection and imaging of objects underwater (or objects obscured by other backscattering media which is at least partially transmitting to light such as ice, snow, fog, dust and smoke) from an airborne platform has been described in U.S. Pat. No. 4,862,257 and U.S. Pat. No. 5,013,917, both of which are assigned to the assignee hereof and incorporated herein by reference. The imaging lidar system of U.S. Pat. No. 4,862,257 utilizes a laser to generate short pulses of light with pulse widths on the order of nanoseconds. The laser light is expanded by optics and projected down toward the surface of the water and to an object or target. U.S. Pat. No. 5,013,917 relates to an imaging lidar system intended for night vision.

Imaging lidar systems of the type described hereinabove are also disclosed in commonly assigned U.S. Pat. No. 4,964,721, and U.S. Pat. No. 4,967,270, both of which are incorporated herein by reference. U.S. Pat. No. 4,964,721 relates to an imaging lidar system which controls camera gating based on input from the aircraft on-board altimeter and uses a computer to thereby adjust total time delay so as to automatically track changing platform altitude. U.S. Pat. No. 4,967,270 relates to a lidar system employing a plurality of gated cameras which are individually triggered after preselected time delays to obtain multiple subimages laterally across a target image. These multiple subimages are then put together in a mosaic in a computer to provide a complete image of a target plane preferably using only a single light pulse.

U.S. Ser. No. 565,631 filed Aug. 10, 1990 which is also assigned to the assignee hereof and fully incorporated herein by reference, relates to an airborne imaging lidar system which employs a plurality of pulsed laser transmitters, a plurality of gated and intensified array camera receivers, an optical scanner for increased field of regard, and a computer for system control, automatic target detection and display generation. U.S. Ser. No. 565,631 provides a means for rapidly searching a large volume of the backscattering medium (e.g., water) for specified targets and improves upon prior art devices in performance as a result of having more energy in each laser pulse (due to simultaneous operation of multiple lasers) and a more sensitive detection system using multiple cameras. The several cameras may be utilized to image different range gates on a single laser pulse or several cameras can be gated on at the same time to provide independent pictures which can then be averaged to reduce the noise level and improve sensitivity. Both of these improvements result in higher signal-to-noise ratio and thus higher probability of detection or greater range of depth capability.

Still other imaging lidar systems are disclosed in U.S. Pat. Nos. 5,029,009 and 5,034,810, both of which are assigned to the assignee hereof and incorporated herein by reference.

While the imaging lidar systems described above are well suited for their intended purposes and are successfully utilized to detect various underwater and drifting obstructions, there is a need for a device to actually destroy these obstructions once located. Presently, it is very expensive and time consuming to effect destruction of underwater hazards such as mines and the like; and the systems used to destroy such hazards often lack the required precision and accuracy. In some applications, it is customary to use divers to remove the underwater hazards. It will be appreciated that such use of divers can be dangerous and time consuming.

SUMMARY OF THE INVENTION

The above-described and other drawbacks and deficiencies of the prior art are overcome or alleviated by the present invention which affords an inexpensive and efficient means of identifying and destroying floating, submerged and suspended navigational obstructions using a battery powered underwater vehicle deployed from an airborne platform and guided by an imaging lidar system supported by the airborne platform.

More particularly, the present invention comprises an air launched submersible vehicle which can be launched, for example, from the sonobuoy carrying racks of a rotary wing aircraft (or any other suitable airborne platform). Upon identification and classification of the target by the imaging lidar system, the submersible vehicle is ejected from the carrying rack upon command. A vehicle drogue parachute is then deployed. Upon impact with the water, guidance is activated and the high explosive charge is fully armed. This vehicle (now in the water) is provided the depth of the target and leaves a trailing wire or buoy afloat for communications (or alternatively uses a raised antenna which extends above the water line); and is initially guided to the vicinity of the target automatically by radio signals from the computer associated with the imaging lidar system. Alternatively, the underwater vehicle can be hardwired directly to the airborne platform using a fiber optic cable. When the target and the underwater vehicle are both imaged simultaneously on the screen, the vehicle is then guided to the target by the same signals transmitted through the trailing wire antenna. The vehicle automatically maintains the depth of the target making the homing problem two dimensional.

Initially, the vehicle will travel in a random direction. The imaging computer (associated with the imaging lidar system on-board the airborne platform) uses the vehicle's motion relative to the fixed target (eliminating the effects of imaging platform motion) to determine its course. The relative location of the two objects is used to determine the required course for intercept. The difference between actual and required courses will be corrected by the computer's issuance of a steering command to the left or right for the appropriate number of seconds. Following a short, post-steer stabilization period, required and actual courses will be recomputed and the process repeated. These iterations allow automatic homing of the vehicle to target with no vehicle communication back to the host platform or on-board guidance.

Detonation of the explosive payload is also preferably controlled by the computer on-board the airborne platform. By projecting the future position of the vehicle relative to the target, the computer can determine the closest point of approach and send a detonation signal accordingly. Should the closest point of approach be beyond the "assured kill" radius, no detonation signal will be sent. The vehicle will simply pass by the target and automatically reengage as new required courses are computed and steering commands issued. A contact fuse may also detonate the vehicle on impact with the target. Should the vehicle fail to make "contact" with the target and thus fail to detonate, the high expolsive may then be detonated by a salvage fuzing at the end of its propulsion cycle or after passing below a preselected depth.

In the backup mode of operation, the video console operator expands the field of his target image until the vehicle is detected. At this time, the console operator activates depth control, which automatically positions the vehicle at the depth of the target. Guidance consists of sequential commands to the vehicle rudder. Upon approach to the target, a high explosive or shaped charge is detonated on command from the console operator, thereby destroying the target.

A number of variations on the preferred embodiment are described. Either shaped charges or insensitive high explosive charges are used, depending on the nature of the target. When the target is floating, the vehicle is set for positive buoyancy, eliminating the need for internal independent depth control. A small pop-up antenna can be used for surface deployment to receive the guidance and destruct signals, eliminating the need for the trailing antenna.

The above-discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1A:
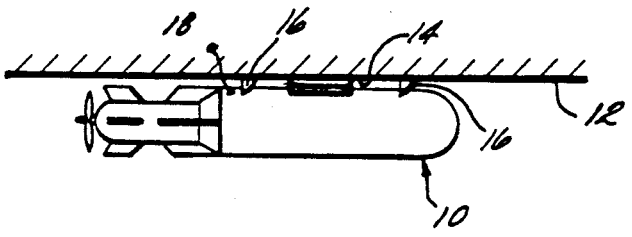
FIGS. 1A-1F are sequential side elevation views depicting the launching of the vehicle from an airborne platform and deployment against a surface target in accordance with the present invention.

The present invention comprises an underwater maneuverable vehicle which carries an explosive charge and is used for immediate removal or destruction of various menaces to navigation and other underwater hazards. The battery powered vehicle is air dropped from a platform (e.g., helicopter) which carries an imaging lidar system for detection of the underwater hazard. The underwater vehicle is operated and navigationally controlled in conjunction with the lidar system. Alternatively, the submerged maneuverable vehicle may also be navigationally controlled by imaging sonar or a similar imaging system.

Referring now to TABLE 1, the various modes of deploying the present invention are shown.

TABLE 1

| | Surface Mode | Submerged Mode | Bulk Explosive | Shaped Charge |
|---|---|---|---|---|
| Communications | Pop Up Antenna | Floating Wire/Buoy | | |
| Buoyancy | Positive | Negative/ Neutral | | |
| Flooding | Set[1] | Set[2] | | |
| Depth Control | None[3] | Set | | |
| Course Control | Operator (Rudder) | Operator | | |
| Detonation | Command | Command (Auto) | Command | Auto |
| Fuzing | On Water | Depth - 10 | | |
| Firing | | | Proximity | Proximal Bearing |

[1]Flooding port closed by command at launch for surface deployment.
[2]Flooding port normally open. No command required.
[3]No depth control used for surface action. Note, if set depth is deeper than three (3) feet, depth control is used.

Two principal operating modes are shown in TABLE 1 including (1) the surface mode where floating obstructions are encountered and destroyed; and (2) the underwater mode where targets floating, bottomed or moored a significant distance below the water must be removed. In the surface mode of operation (FIGS. 1A-1F and 2), console settings are initially provided for flooding, fusing and antenna deployment. The vehicle is then released from the platform and is slowed before entry to the water by a small drogue parachute, which is detached upon water entry. In this surface mode of operation, a small pop-up antenna is deployed and the vehicle propulsion motor is activated. Immediate activation is not necessary, as propulsion for depth control is not required. Should it be deemed advantageous to maintain a negative buoyancy at all times, the flooding ballast approach will not be used but rather, the automatic depth control will be set to maintain the vehicle at or slightly below the surface for all target depths. When the vehicle is acquired by the imaging lidar system on-board the platform, the propulsion motor is activated on command and guided to the vicinity of the target. Guidance is accomplished automatically by the imaging computer or manually with the operator observing the image of the target and the vehicle on the video screen of the lidar system and manually guiding the vehicle to the vicinity of the target. Upon reaching the closest point of approach, the explosive or shaped charge is detonated by computer signal or operator command. Additional instruction may be used for correct orientation of a shaped charge, particularly at depths below the surface.

For targets below the surface (FIGS. 3A-D and 4A-B), the vehicle flooding ports remain open, and the depth of the target is set in. The depth is determined from the imaging lidar; it is set at the depth where the target becomes obscuring, rather than reflective. The vehicle is launched, the drogue chute is deployed and the vehicle enters the water. The free flooding area is flooded, since the ports have not been closed, and the vehicle now has slightly negative buoyancy. The vehicle begins to swim downward, with the explosive fusing some ten feet above the set depth. At the same time, the floating wire antenna is deployed. The vehicle is guided in azimuth as before, with a horizontal stabilizer providing depth control. The free flooding ports (if this option is used) are closed, so that the vehicle retains positive buoyancy. Using the video presentation, the vehicle is guided to the target as before by RF signals received through the floating antenna. The explosive charge is detonated at the time the operator sees the vehicle approach the target closely enough for it to break up.

Turning now to FIGS. 1A-F, the above-described sequence for vehicle launch against a surface target is shown. Referring to FIG. 1A, a submersible vehicle 10 in accordance with the present invention is shown mounted on a platform 12 attached to a rack 14 by clamps 16.

Figure 1B:
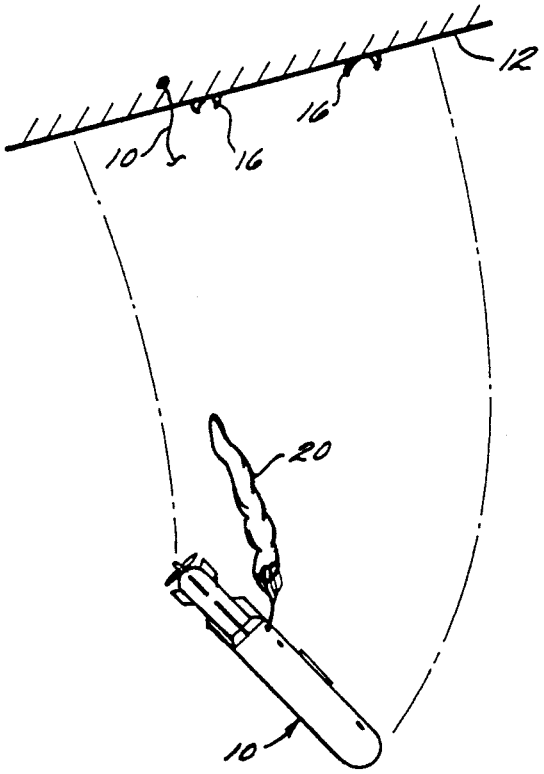
Figure 1B:
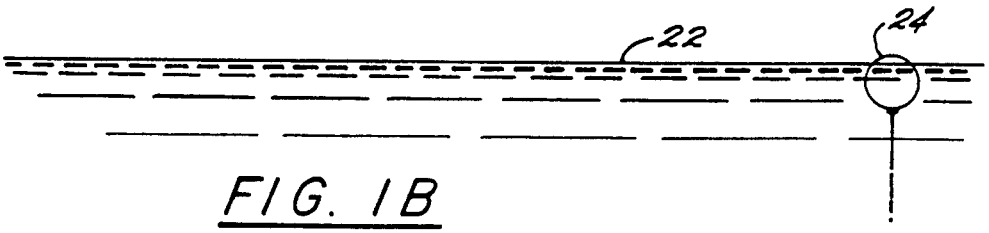
Figure 1C:
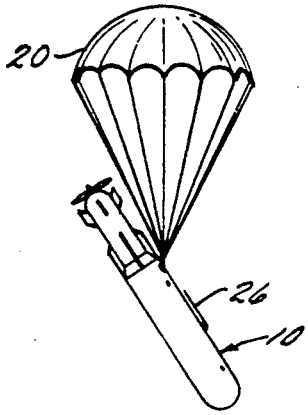
Figure 1D:
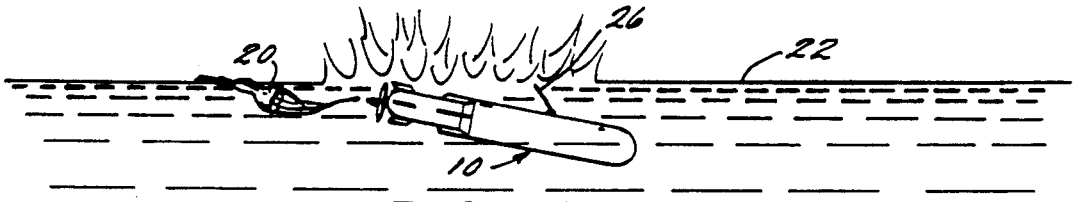
Figure 1E:
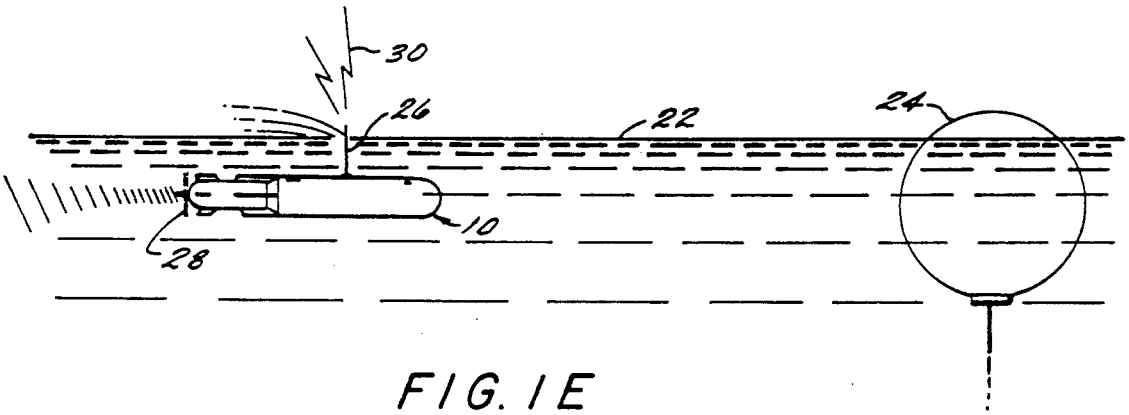
Figure 1F:
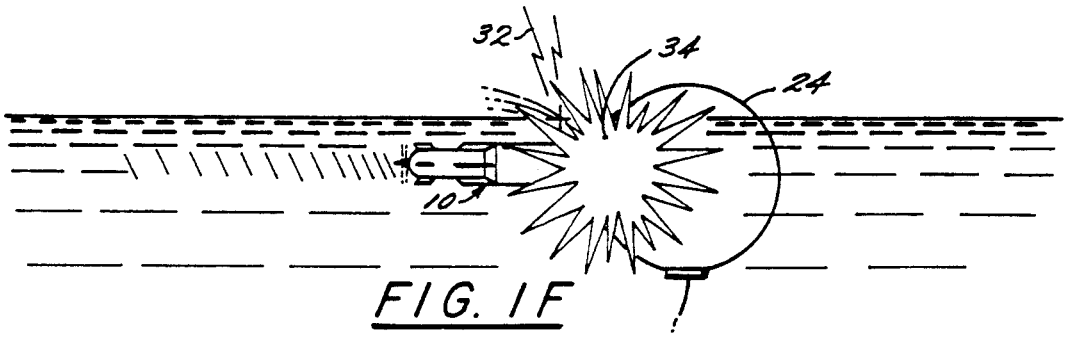

Instructional inputs to vehicle 10 at launch are provided by an umbilical cord 18 which communicates with an on-board command computer associated with an imaging lidar system (which is also on-board platform 12). In FIG. 1B, clamps 16 have released, vehicle 10 has left rack 14, the umbilical cord 18 is detached and a drogue chute 20 is beginning to deploy as the vehicle approaches water 22 on which a target 24 is floating. As shown in FIG. 1C, drogue chute 20 is not fully deployed, slowing the fall of the vehicle to the water surface. At this time, the console settings (see FIG. 5) are for deployment of a pop-up antenna 26. Therefore, no depth control, closure of the flooding ports, and fusing are required to set on water entry. In FIG. 1D, vehicle 10 has entered water 22 and shed the drogue chute 20. Pop-up antenna 26 is in place and ready to receive rf signals. FIG. 1E shows vehicle 10 under power via propeller 28 receiving rf steering commands 30 from the console operator who now views both target 24 and vehicle 10 images on a real time video screen as will be shown in FIG. 2. In FIG. 1F, a detonation command 32 has been sent, the explosive or shaped charge has exploded at 34 and the target 24 has been destroyed. The console operator then observes the debris or fragments of target 24 as they slowly disperse, indicating the complete destruction of the navigational hazard.

In the event that the flooding ports do not close, automatic depth control will commence at a depth of three feet, and the floating antenna will deploy (see FIGS. 3A-D). These actions are initiated by a depth sensor (see FIG. 6).

In accordance with the present invention, any suitable imaging sensor may be used to control and simultaneously view the underwater vehicle and the target. Examples of suitable imaging sensors include imaging lidar systems and imaging sonar systems. Preferably, an imaging lidar system of the type discussed in the Background Section (such as U.S. Pat. Nos. 4,862,257, 4,964,721, 4,967,270, 5,013,917, 5,029,009, 5,034,810 or U.S. Ser. No. 565,631) is employed in the present invention. As already discussed, imaging systems of this type image a volume of water using a pulsed laser transmitter in combination with one or more gated cameras.

Figure 2:
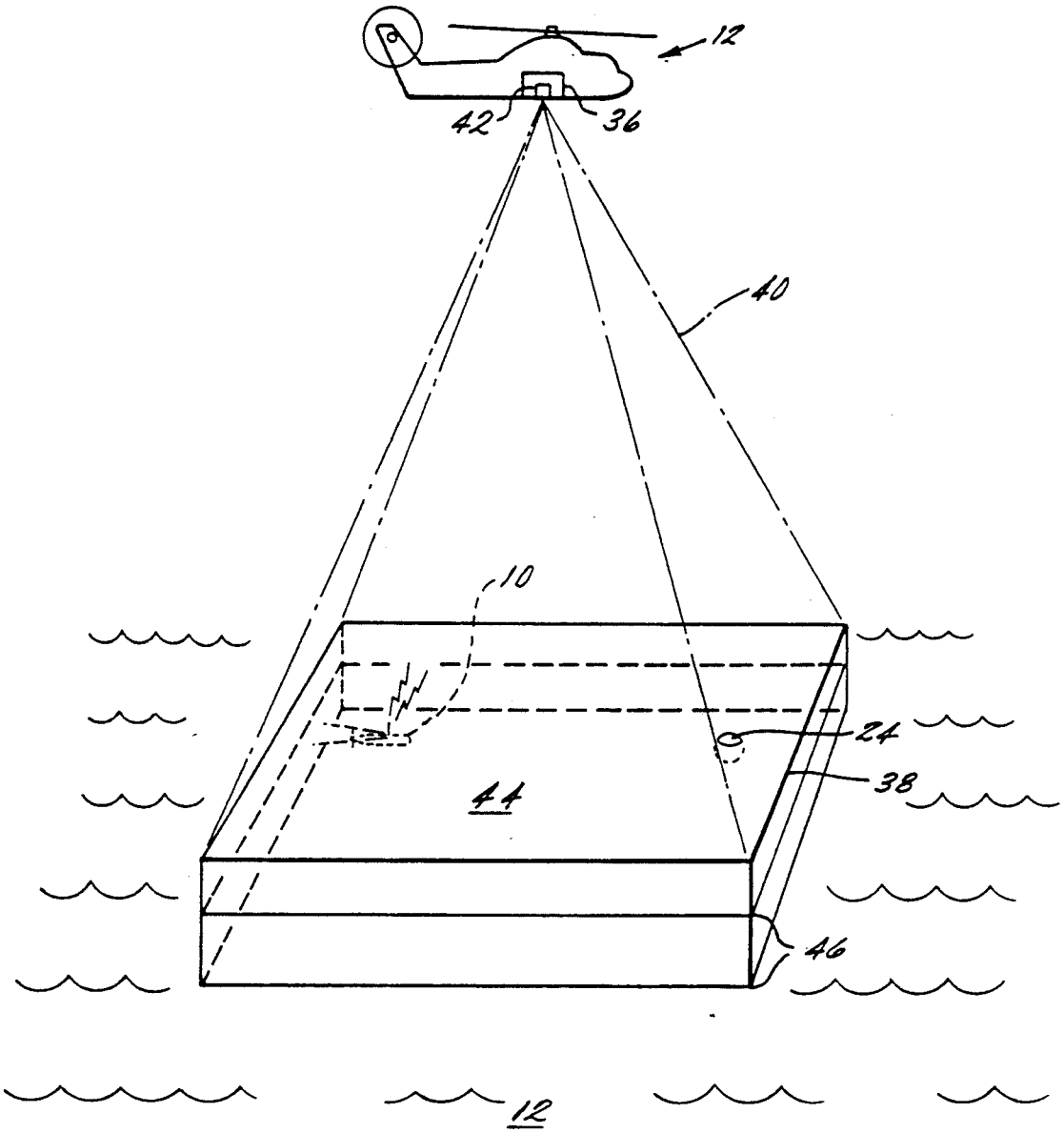
FIG. 2 is a diagrammatic view showing the use of a lidar imaging system in guiding the vehicle to a floating surface target in accordance with the present invention.
Figure 2A:
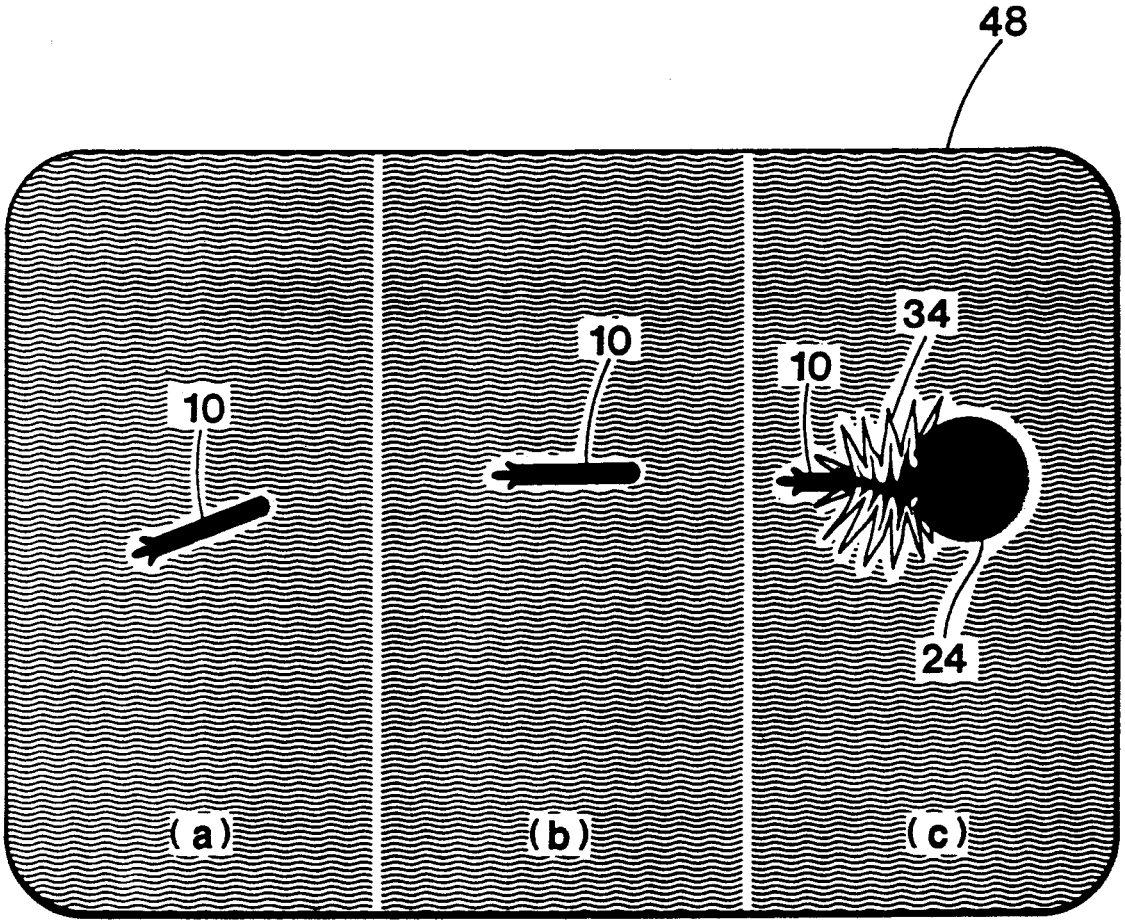
FIG. 2A is a front elevation view depicting the video presentation seen by the console operator in the various modes of deployment shown in FIGS. 1A-F.
Figure 3A:
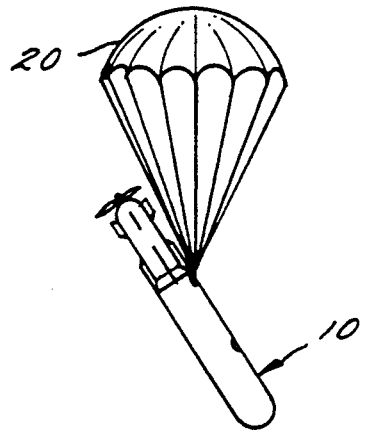
FIGS. 3A through 3D are sequential side elevation views depicting the deployment of the vehicle against a target at depth in accordance with the present invention.
Figure 3B:
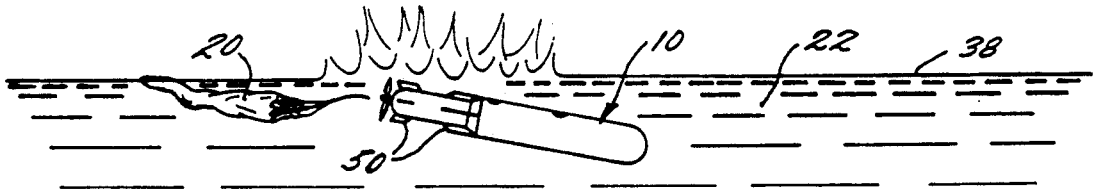
Figure 3C:
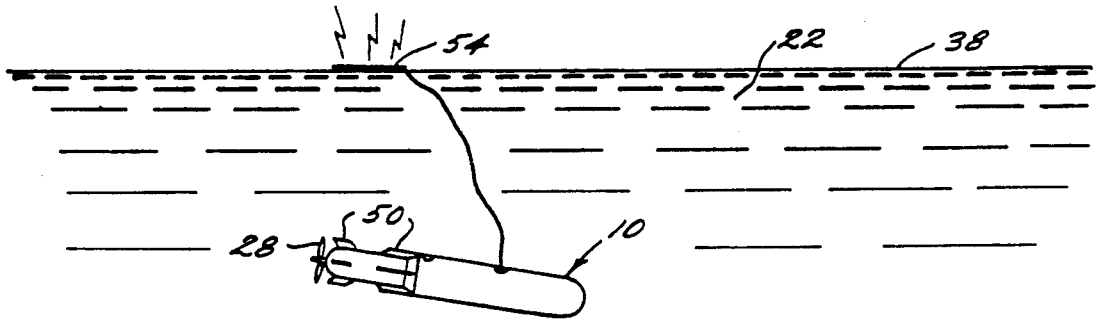
Figure 3D:
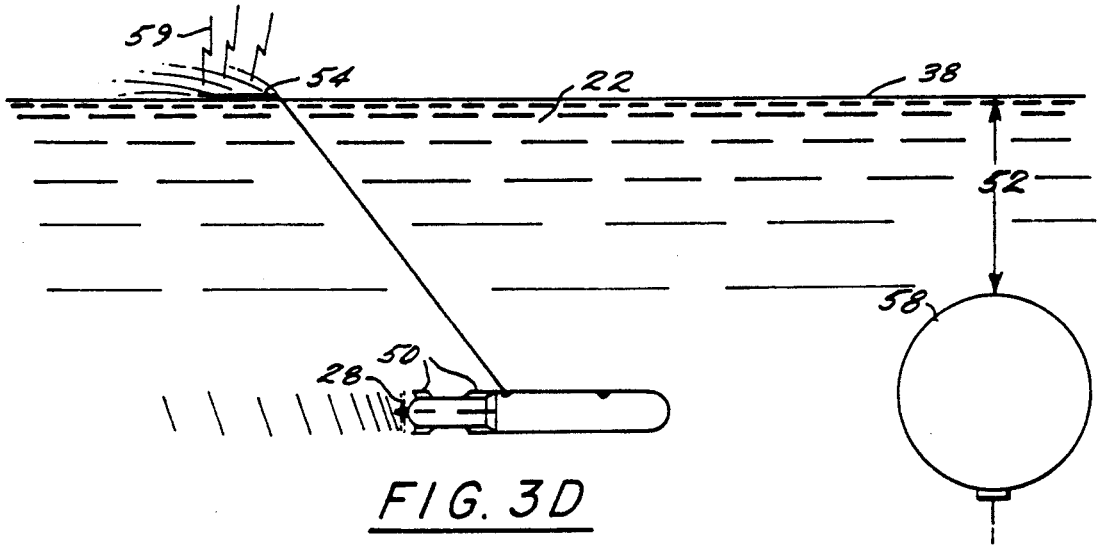

Referring now to FIG. 2, an airborne platform (e.g., helicopter) 12 is shown having an imaging lidar system 36 of the aforementioned type positioned on-board. The lidar imaging system is shown having detected the target 24, determined it to be on the surface 38 of water 12, and is now imaging both the vehicle 10 and the target 24. The illumination 40 from the laser transmitter 42 covers a rectangular area 44 and is gated below the water surface so that the illumination of the underwater region or volume 46 is achieved. Since gated region 46 of illumination is below both target 24 and vehicle 10, both appear as shadows on the video console. In FIG. 2A, sequential depictions are shown (at (a), (b) and (c)), as seen from the console 48 in the platform 12, the vehicle 10 (seen in shadow) is being guided to the target 24 (also seen in shadow) with the console operator sending the appropriate guidance signals to provide course corrections. (These signals are sent to a servo system 48 which operates a vertical rudder 50 shown in FIG. 6). In sequence (c) of FIG. 2A, the vehicle 10 has approached the target sufficiently closely so that the explosive charge is detonated (at 34) thereby destroying the target 24 which then sinks to the bottom of the body of water 22.

In FIGS. 3 and 4, the approach to and destruction of a submerged target (as opposed to the floating target 24 of FIG. 1) is shown. The imaging lidar system has detected a submerged target 58 in the submerged target option. Upon entry into the water 22, the free space in the vehicle will flood causing it to have slightly negative buoyancy and the depth control option will now take over with target depth preset by the console operator. At the same time, a floating antenna 54 deploys after water entry. In FIG. 3A, the drogue chute 20 is fully deployed as the vehicle 10 falls toward the water. Upon entry, as seen in FIG. 3B, the vehicle 10 sheds the drogue chute 20 and commences deployment of the floating wire antenna 54. The pop-up antenna 26 shown previously in FIG. 1, can be deployed or remain housed. In FIG. 3B it has remained housed. In FIG. 3C, vehicle 10 is proceeding downward to target depth, driven by its negative buoyancy and the downward thrust provided by its propellers and the pitch of the horizontal stabilizers 56. The floating antenna 54 is now fully deployed and receiving guidance signals from the platform 12, activating the servo system 48 and moving the rudder 50. In FIG. 4D, vehicle 10 is at the preset (target) depth, has levelled off and is now within close range of the target 58. At the closest point of approach to target 58, the console operator sends the detonation signal 60, and in a short time target 58 will be destroyed. Alternatively, detonation can take place automatically by computer recognition of the closest point of approach or by direct contact.

Figure 4A:
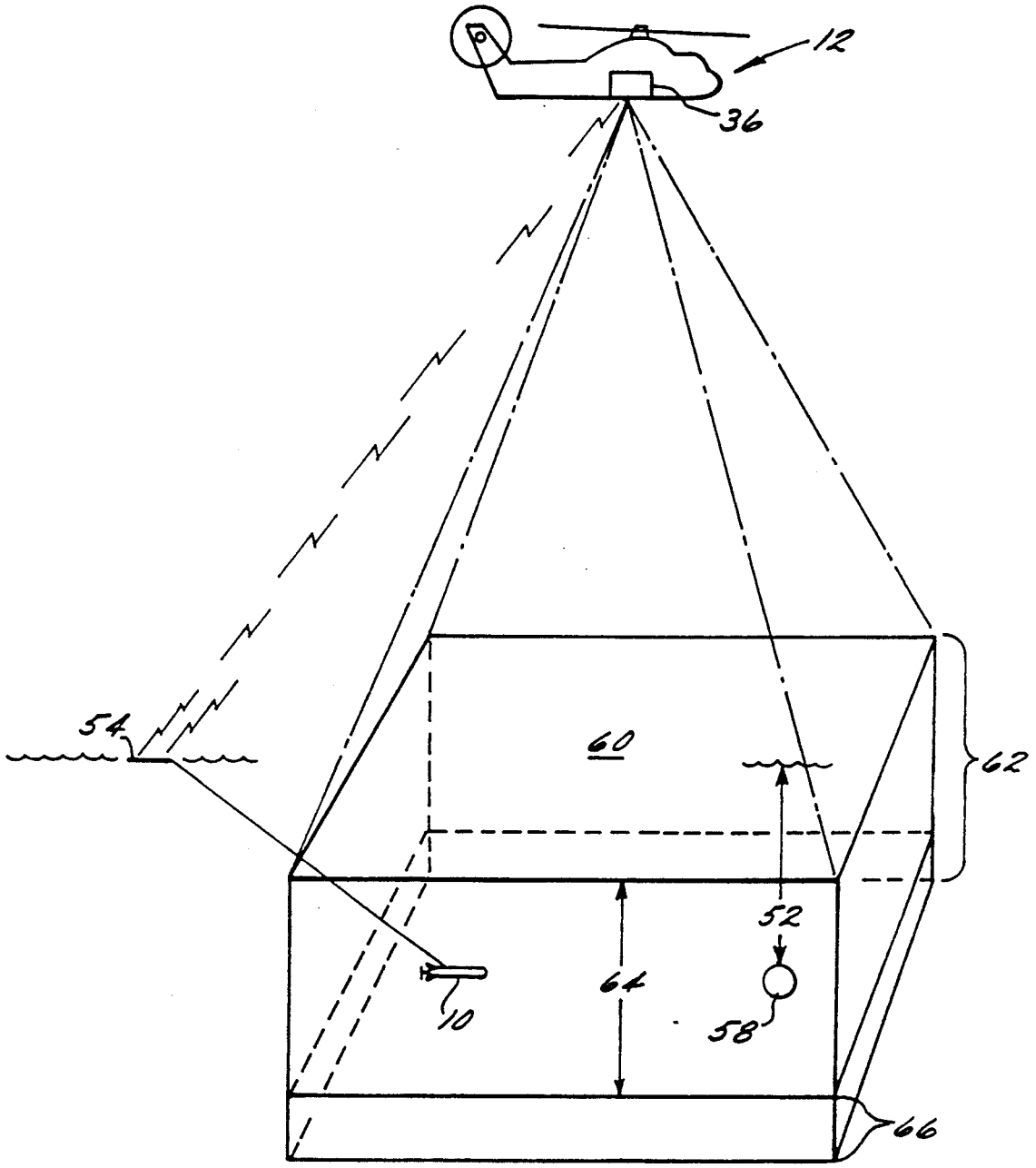
FIGS. 4A through 4B are diagrammatic views showing the use of the lidar imaging system against a submerged target in accordance with the present invention.
Figure 4B:
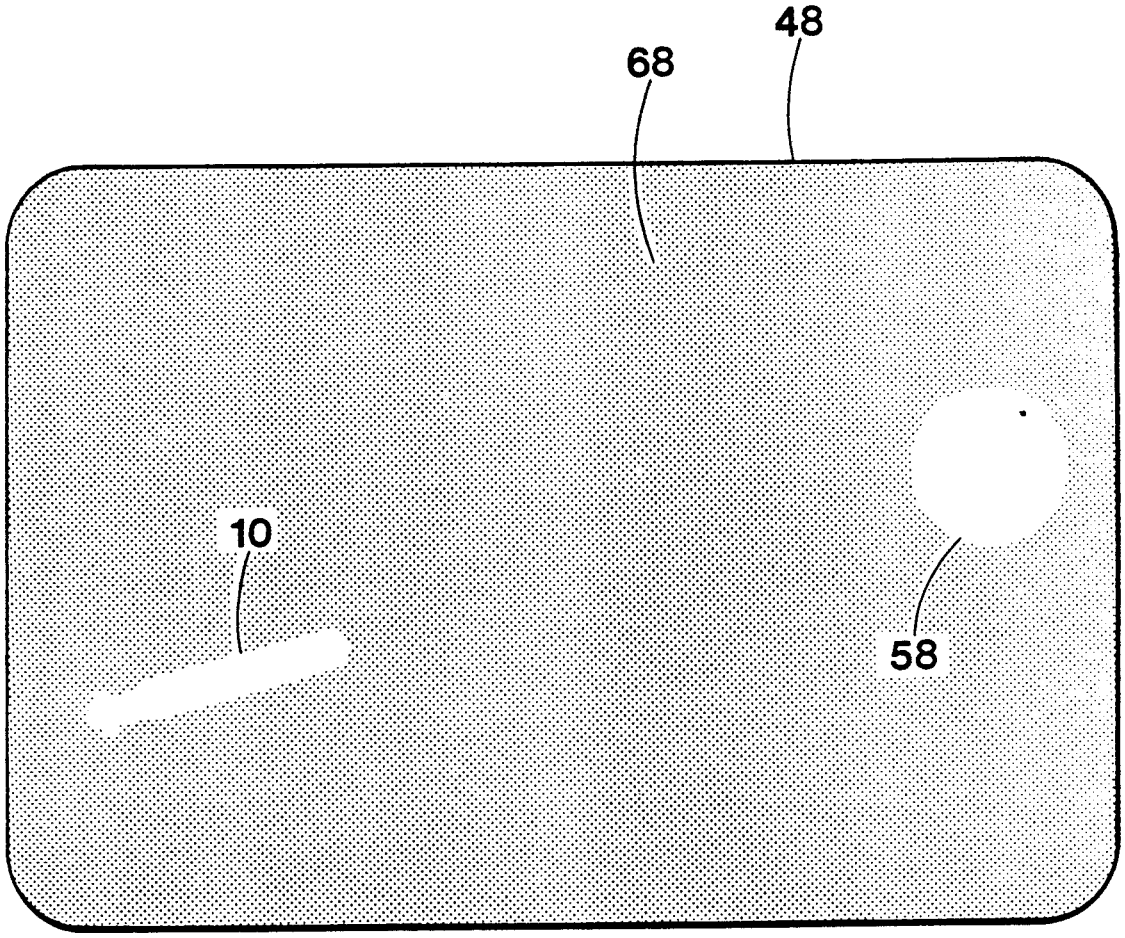

FIG. 4A shows the target 58, platform 12 and vehicle 10 configuration during the submerged approach. The vehicle 10 has reached target depth 52 and is maintained at that depth by the automatic depth control servo system which controls the horizontal stabilizers. The floating wire antenna 54 has been deployed and is receiving rf signals (originated by the console operator) from the platform 12. The imaging lidar system 36 is illuminating an area 60 on the ocean surface and the receiving cameras are gated to view the illuminated region 62. The top of this region 64 is somewhat closer to the surface of the water than the vehicle 10 and target 58; and it is less than the target depth 52. The bottom 66 of the region 62 is below both target 58 and vehicle 10. Thus, the region 62 viewed includes both target 58 and vehicle 10, and they are seen in reflection. This is shown in the video image depicted in FIG. 4B. Here, the target 58 and vehicle 10 appear as bright objects against the gray background 68.

Figure 5:
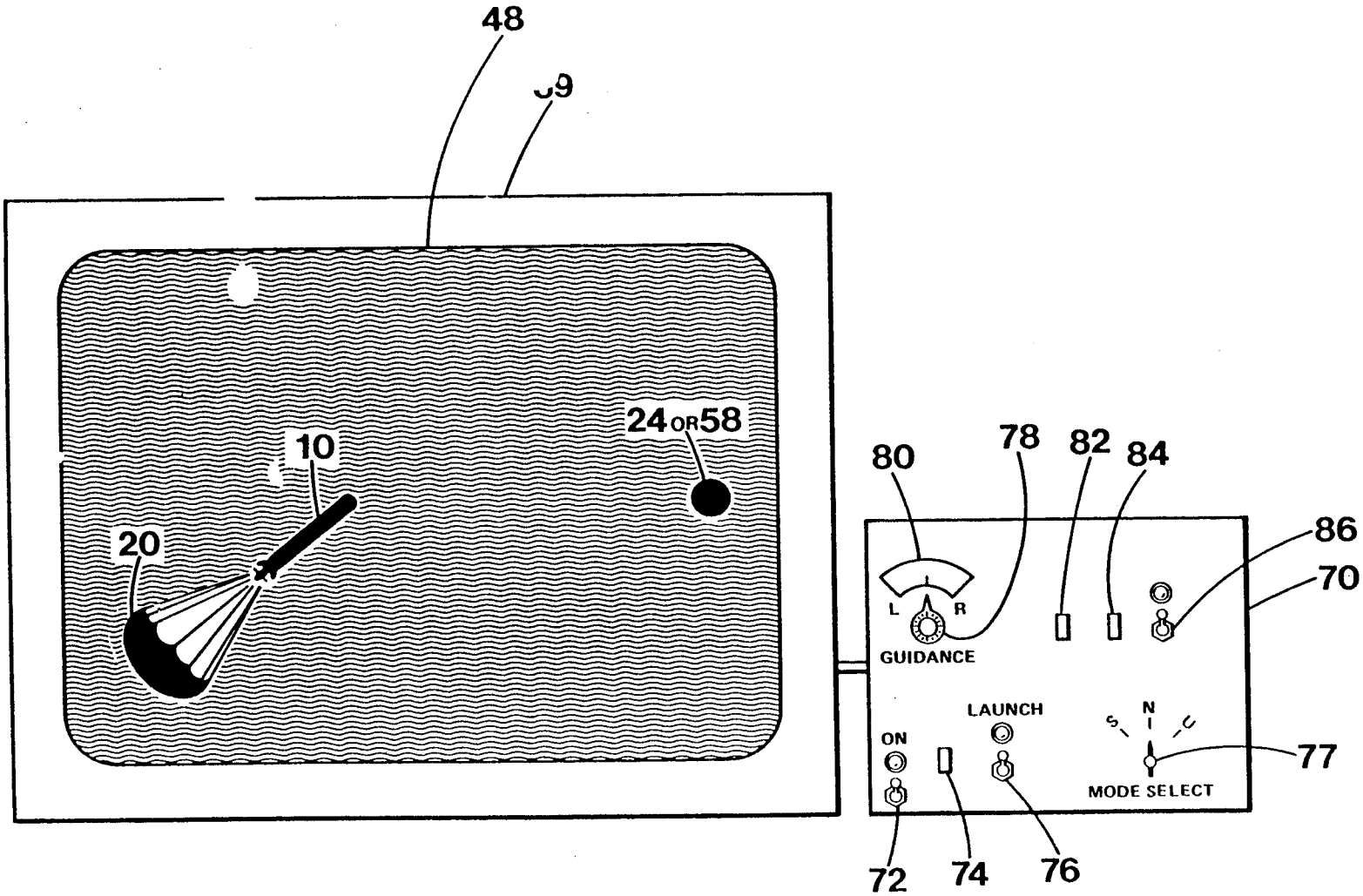
FIG. 5 is a front elevation view depicting the console and the video presentation seen by the console operator in various modes of deployment of the present invention.

The console operator's view is shown in FIG. 5. The video console 69 is positioned in front of the operator from which the operator can see both vehicle 10 and target 24 or 58. Early detection of the vehicle is enchanced by the opening of the drogue chute 20, which is optically opaque, and is readily seen on the screen 48. To the right of the screen is the control panel 70. The control panel has the following settings power 72, launch safety 74, launch 76, mode (surface=S, underwater=U, neutral=N) select 77, guidance 78, rudder angle indicator 80, fusing 82, detonate safety 84 and detonate 86. The surface and underwater settings automatically activate (or deactivate) depth control, flooding, etc., as discussed previously.

Figure 6:
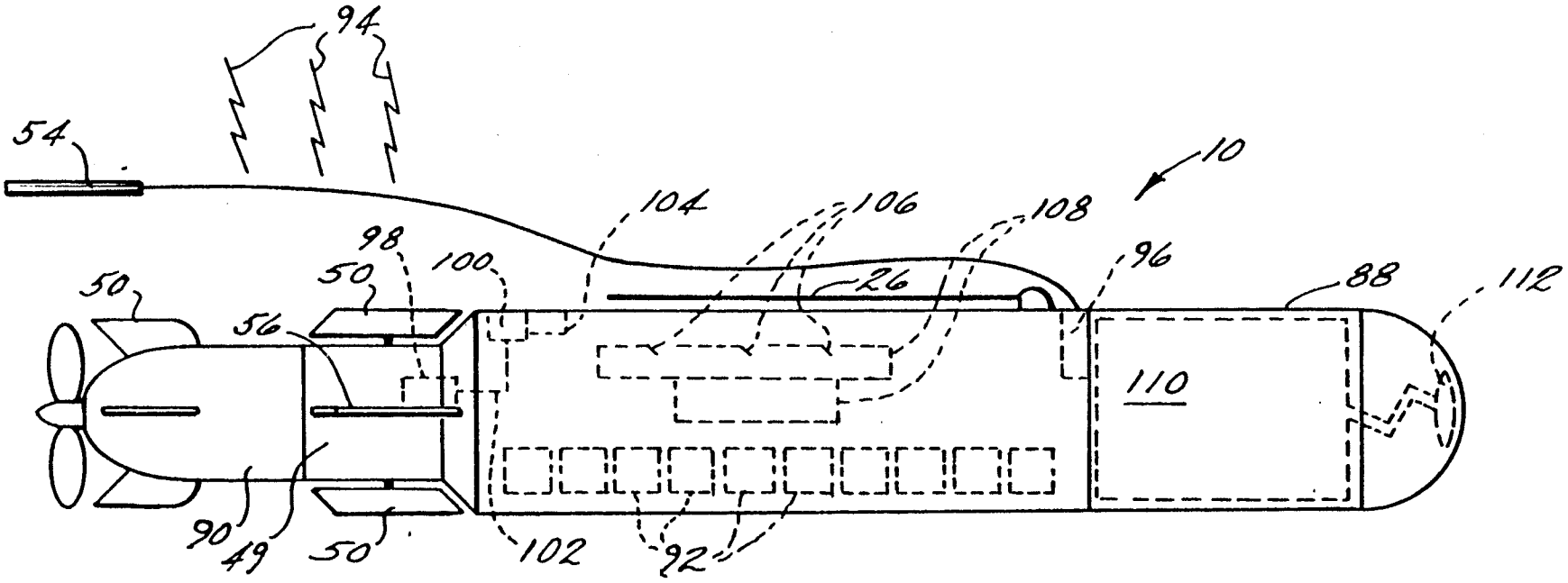
FIG. 6 is a front view, partly in cross-section, depicting a detailed schematic of the vehicle in accordance with the present invention.

FIG. 6 is a detailed schematic of the vehicle 10 and the vehicle housing 88. Propulsion is provided by an 18 pounds of thrust trolling motor 90 (12 VDL, 28A) driven by a bank of 12 V 30 A lithium batteries 92. Motor 90 runs continuously upon water entry. The rf signals 94 are received by the antenna 26 or 54 and travel to the receiver 96 and then to the software/control module 98 which provides commands to the servo control 48. The servo control 48 then controls the vertical rudder 50 thereby steering the vehicle. A piezoelectric depth transducer 100 provides its input 102 to the software control module 98. This indication of depth is used by the software control system to control vehicle depth with the servo system 48 operating the horizontal stabilizers 56. The umbilical fitting 104 provides input to the control unit 98, providing the initial settings for underwater or surface operation. The control unit 98 also operates the ports 106 to the free flooding space 108 (again depending on the mode of operation). As mentioned earlier, ports 106 (if used) are closed for surface operation. The surface of the vehicle is preferably at least partially covered by a bright Lambertian reflecting paint so it can be easily imaged down to the required depth, but not so bright as to interfere with the imaging lidar camera gain control. The high explosive 110 in the form of a charge or shaped charge can be detonated on command, or by a contact influence fuse 112 as shown. Preferably, housing 88 has a lengthy of 36 inches and a height of $4\frac{7}{8}$ inches; these dimensions being compatible with presently existing carriers found on rotary wing aircraft.

Figure 7:
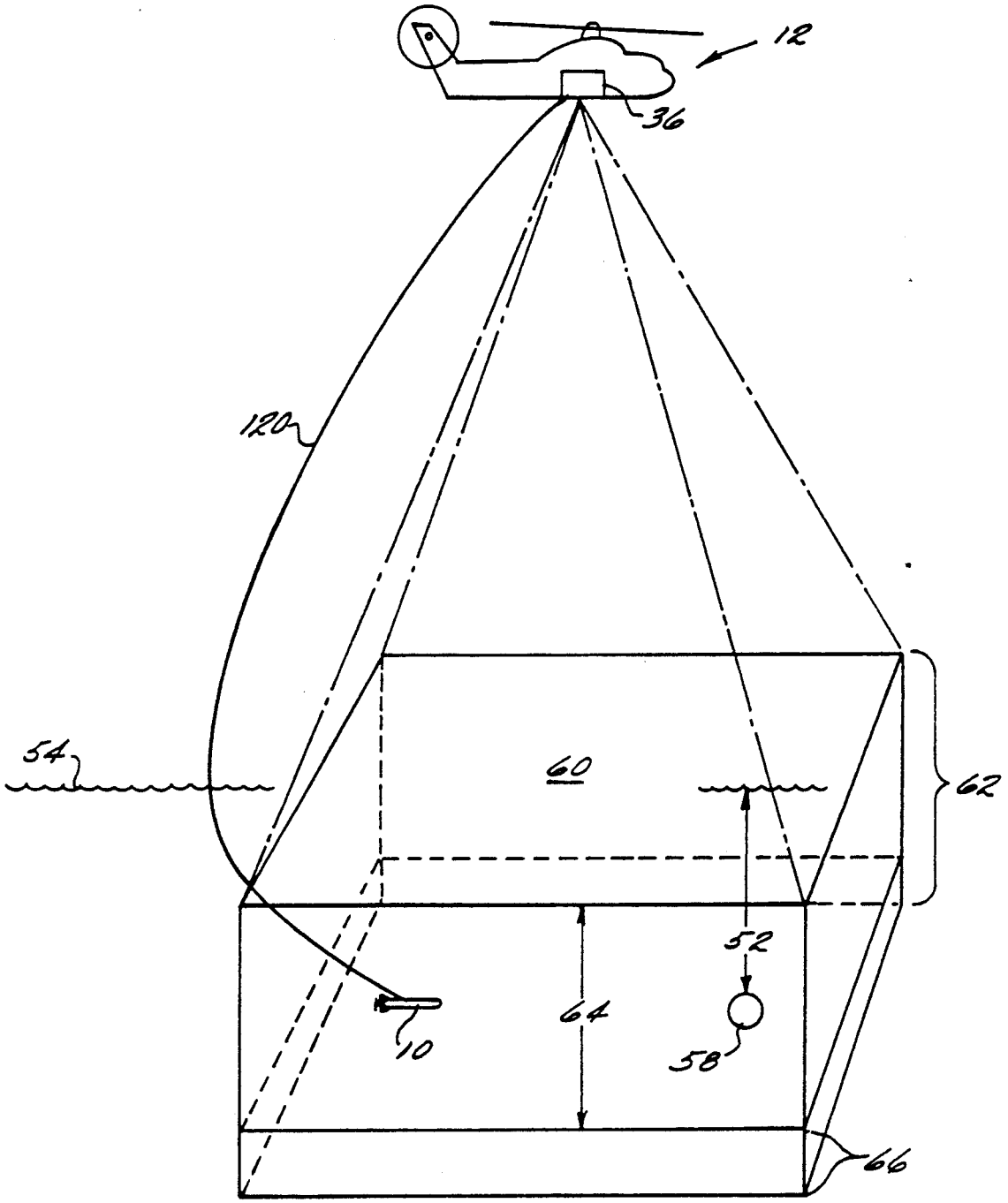
FIG. 7 is a diagrammatic view, similar to FIG. 4A, depicting a fiber optic connection between the airborne platform and the vehicle.

FIG. 7 is a schematic of the present invention similar to FIG. 4A with the significant exception that imaging lidar system 36 is hardwired directly to vehicle 10 using fiber optic cable 120. Use of hardwired cable 120 eliminates the need for either pop-up antenna 26 (see FIG. 2) or floating wire antenna 54 (see FIG. 4A). The use of fiber optic communication (as opposed to Rf communications) leads to many important advantages and benefits. For example, fiber optics permits (1) faster data rates, (2) covert communications and (3) may eliminate the need for an on-board computer (e.g., control module 98 in FIG. 6).

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Apparatus for removal of navigational hazards in the water from a platform positioned above the water, comprising:

(1) a discrete vehicle detachably attachable to said platform, said vehicle including;
  (a) propulsion means for moving said vehicle in water;
  (b) directional guidance means for directionally maneuvering said vehicle in water;
  (c) explosive means for detonating said vehicle at a selected navigational hazard;
  (d) control means for controlling said directional guidance means; and
  (e) communications means for communicating navigational instructions to said control means;

(2) imaging sensor means positioned on said platform, said imaging sensor means providing images of both a selected navigational hazard and said vehicle; and (3) command means for wireless transmission of navigational instructions to said communication means of said vehicle, said navigational instructions being responsive to said images from said imaging sensor means.

2. The apparatus of claim 1 wherein:

said platform comprises an airborne platform.

3. The apparatus of claim 2 wherein:

said airborne platform comprises a rotary wing aricraft.

4. The apparatus of claim 1 wherein:

said control means also controls said explosive means; and wherein said command means also transmits instructions to said communications means regarding detonation of said explosive means.

5. The apparatus of claim 1 wherein:

said communications means comprises antenna means.

6. The apparatus of claim 5 wherein:

said antenna means comprises floating antenna means.

7. The apparatus of claim 1 wherein:

said imaging sensor means comprises imaging lidar sensor means.

8. The apparatus of claim 7 wherein said imaging lidar means comprises:

means for selectively generating short pulses of light using transmitter means;

means for projecting said short pulses of light toward water and at a navigational hazard disposed in a target volume at least partially enveloped by the water;

gated camera means for receiving said pulses of light reflected back from said target volume after a time delay corresponding to the round-trip propagation time of said light pulses to and from said target volume using receiver means; and means for converting said received pulses of light to a video image of said navigational hazard in said target volume.

9. The apparatus of claim 1 wherein said wireless transmission comprises rf signals.

10. The apparatus of claim 1 wherein:

said command means comprises a computer associated with said imaging sensor means.

11. The apparatus of claim 1 including:

detachable parachute means attached to said vehicle.

12. The apparatus of claim 1 wherein:

said command means transmits navigational instructions iteratively in response to said images.

13. The apparatus of claim 1 wherein:

said command means also transmits instructions to said communications means regarding depth of a selected navigational hazard.

14. The apparatus of claim 13 wherein said vehicle further includes:

a free flooding space;

at least one flood port for admitting water into said free flooding space; and wherein said control means controls opening of said flood port in response to instructions communicated to said communications means from said command means.

15. The apparatus of claim 1 wherein:

said imagaing sensor means provides said images in obscuration.

16. The apparatus of claim 1 wherein:

said imaging sensor means provides said images in reflection.

17. The apparatus of claim 1 including:

fiber optic means connected between said discrete vehicle and said imaging sensor means.

18. A method of removing navigational hazards in the water comprising the steps of:

releasing a discrete maneuverable vehicle into a body of water from a platform, the vehicle including explosive means for detonating said vehicle at a selected navigational hazard;

using imaging sensor means positioned on said platform to obtain an image of said released vehicle and a selected navigational hazard;

controlling the direction of movement of said vehicle from said platform based on image input from said imaging sensor means wherein said vehicle is directed to a vicinity at or near the selected navigational hazard and wherein said explosive means is detonated to remove said navigational hazard.

19. The method of claim 18 including:

using wireless transmission means to direct said vehicle movement.

20. The method of claim 19 wherein:

said wireless transmission means comprises rf signals.

21. The method of claim 18 wherein:

said imaging sensor means comprises imaging lidar sensor means.

22. The method of claim 21 wherein said imaging lidar means comprises:

means for selectively generating short pulses of light using transmitter means;

means for projecting said short pulses of light toward water and at a navigational hazard disposed in a target volume at least partially enveloped by the water;

gated camera means for receiving said pulses of light reflected back from said target volume after a time delay corresponding to the round-trip propagation time of said light pulses to and from said target volume using receiver means; and means for converting said received pulses of light to a video image of said navigational hazard in said target volume.

23. The method of claim 18 including:

using fiber optic transmission means to direct said vehicle movement.

24. An apparatus for removing navigational hazards in the water comprising:

a discrete maneuverable vehicle releasable into a body of water from a platform, the vehicle including expolsive means for detonating said vehicle at a selected navigational hazard;

imaging sensor means positioned on said platform to obtain an image of said released vehicle and a selected navigational hazard;

means for controlling the direction of movement of said vehicle from said platform based on image input from said imaging sensor means wherein said vehicle is directed to a vicinity at or near the selected navigational hazard and wherein said explosive means is detonated to remove said navigational hazard.

* * * * *